United States Patent [19]

Lau et al.

[11] Patent Number: 4,601,337

[45] Date of Patent: Jul. 22, 1986

[54] FOAM DRIVE OIL DISPLACEMENT WITH OUTFLOW PRESSURE CYCLING

[75] Inventors: Hon C. Lau; Stephen M. O'Brien, both of Houston, Tex.

[73] Assignee: Shell Oil Company, Houston, Tex.

[21] Appl. No.: 609,062

[22] Filed: May 10, 1984

[51] Int. Cl.[4] ..... E21B 43/16

[52] U.S. Cl. ..... 166/263; 166/268

[58] Field of Search ..... 166/273, 275, 263, 300, 166/309, 272, 252, 270, 268, 274

[56] References Cited

U.S. PATENT DOCUMENTS 3,311,167 3/1967 O'Brien et al. ..... 166/263
3,376,924 4/1968 Felsenthal et al. ..... 166/273
3,648,772 3/1972 Earlougher, Jr. ..... 166/273
3,893,511 7/1975 Root ..... 166/274
4,488,976 12/1984 Dilgren et al. ..... 166/272

*Primary Examiner*—Stephen J. Novosad
*Assistant Examiner*—Bruce M. Kisliuk

[57] ABSTRACT

Oil is recovered from a subterranean oil reservoir by injecting foam-forming components through an injection well while preventing fluid outflow from an adjacent production well, so that the pressure is increased in the zone between the wells, then permitting fluid outflow from the production well while continuing the injection, until the rate of the outflow is significantly reduced, and repeating the injecting and outflowing steps until the rate of oil production is significantly reduced.

9 Claims, 4 Drawing Figures

FOAM DRIVE OIL DISPLACEMENT WITH OUTFLOW PRESSURE CYCLING

BACKGROUND OF THE INVENTION

This invention relates to recovering oil from a subterranean reservoir by displacing oil into a production well by injecting foam forming components through an injection well. More particularly, the invention relates to improving the efficiency with which an oil displacing foam is formed throughout most, if not all, of the reservoir interval between injection and production wells.

Numerous processes for recovering oil by injecting foam-forming components into oil-containing subterranean reservoirs have been described in patents such as the following: U.S. Pat. No. 3,269,460 describes injecting liquid containing dissolved gas which bubbles when the pressure is reduced as the liquid moves away from the injection well or encounters a zone of high permeability. U.S. Pat. No. 3,318,379 describes injecting a surfactant solution, then surfactant-free liquid, then gas, so that foam formation occurs relatively far from the injection well. U.S. Pat. No. 3,342,256 describes injecting surfactant solution not later than injecting $CO_2$, then injecting an aqueous liquid, so that thief zones within the reservoir become plugged by foam. U.S. Pat. No. 3,412,793 describes injecting steam and surfactant to form temporarily stable steam foam plugs within thief zones. U.S. Pat. No. 3,464,491 describes injecting foaming agent and gas to form foam plugs in thief zones to improve an underground combustion drive by preventing bypassing flows of air through the thief zones. U.S. Pat. No. 3,491,832 describes injecting alternating slugs of surfactant and gas and using surfactant-free liquid slugs between them to increase the distance of penetration of the foam. U.S. Pat. No. 3,529,668 describes injecting alternating liquid and gas slugs of a specified size behind an aqueous surfactant solution. U.S. Pat. No. 3,893,511 describes recovering oil from reservoirs having interconnected very high and very low permeabilities by injecting surfactant and oil-soluble gas to foam in the permeable zones and divert gas into the oil so that oil is displaced into the permeable zones, breaks the foam in those zones, and flows into producing locations when the pressure in the producing locations is reduced to significantly less than injection pressure. U.S. Pat. No. 4,086,964 describes a steam drive process, for recovering oil from reservoirs susceptible to steam channel formation, by circulating through a steam channel a mixture of steam and foam forming surfactant arranged to increase the pressure gradient within the channel without plugging the channel. U.S. Pat. No. 4,113,011 describes using a specified organic sulfate surfactant at a pressure greater than 1500 psi in an oil recovery process like that of U.S. Pat. No. 3,342,256.

Thus, it appears that the prior art teaches that foams are capable of displacing oil, are capable of plugging permeable zones—and how it may be difficult to cause a foam having such capabilities to be (a) formed within a subterranean reservoir at a significant distance away from an injection well or (b) formed around the injection well and then transmitted through the reservoir.

However, as far as applicants are aware, the prior art suggests nothing regarding the possibility of solving such a foam distribution problem by cyclically lowering the production well pressure while continuing to inject the foaming components. When a mixture of surfactant and gas is injected into a reservoir and is being displaced through the pores of the reservoir, it is known that a forming or strengthening of foam may occur when the mixture encounters a zone of reduced pressure, such as a fracture or highly permeable streak. Such a foam formation or strengthening is said to occur in cyclic stimulation or soak-type oil production operations in which foam components are injected and fluid is produced from a single well or in pressure cycling processes such as those of U.S. Pat. No. 3,893,511, which use an oil-soluble gas to recover oil from "dead-end" pores of a dual permeability reservoir.

SUMMARY OF THE INVENTION

The present invention relates to a process for recovering oil from an oil-containing subterranean reservoir which is encountered by at least one injection well and at least one production well. Foam-forming components including gas, water and surfactant, present in kinds and amounts capable of forming a foam within the pores of the reservoir, are injected through an injection well while allowing little or no fluid outflow through any adjacent production well, so that the fluid pressure is increased within the reservoir and within at least one production well. Fluid is then outflowed from at least one production well in which such a pressure increase has occurred. The fluid is outflowed at a rate sufficient to reduce the formation fluid pressure in and around the well while the injection of fluid through the injection well is continued at a rate at least substantially equalling the initial fluid injection rate. When the reservoir pressure and bottomhole pressure of the outflowing fluid has declined significantly the well is throttled, to again allow little or no fluid outflow, while the injecting of fluid through the injection well is continuing at a rate at least substantially equalling the initial rate of fluid injection. Thus, the pressure is again increased within the reservoir and at least one production well adjacent to the injection well. The sequence of injecting while restricting fluid outflow and producing while continuing fluid injection is repeated, at least one time, while oil is being recovered from the fluid being outflowed.

DESCRIPTION OF THE INVENTION

As used in the present application, the term "strong foam" relates to a relatively high quality foam consisting of a dispersion of relatively fine bubbles of gas or vapor within a liquid. The strong foams are substantially immune to gravity override. The term "weak foam" is used to refer to a lower quality, and thus wetter, foam which has a tendency to segregate into a layer of liquid underlying a layer of gas. The term "foam-forming components" is used herein to refer to a mixture of gas or vapor and aqueous solution or dispersion of surfactant. The foam-forming components preferably also contain sufficient monovalent-cation-containing electrolytes to enhance the activity of the surfactant and sufficient noncondensable gas to enhance the strength of foams.

Figure 1:
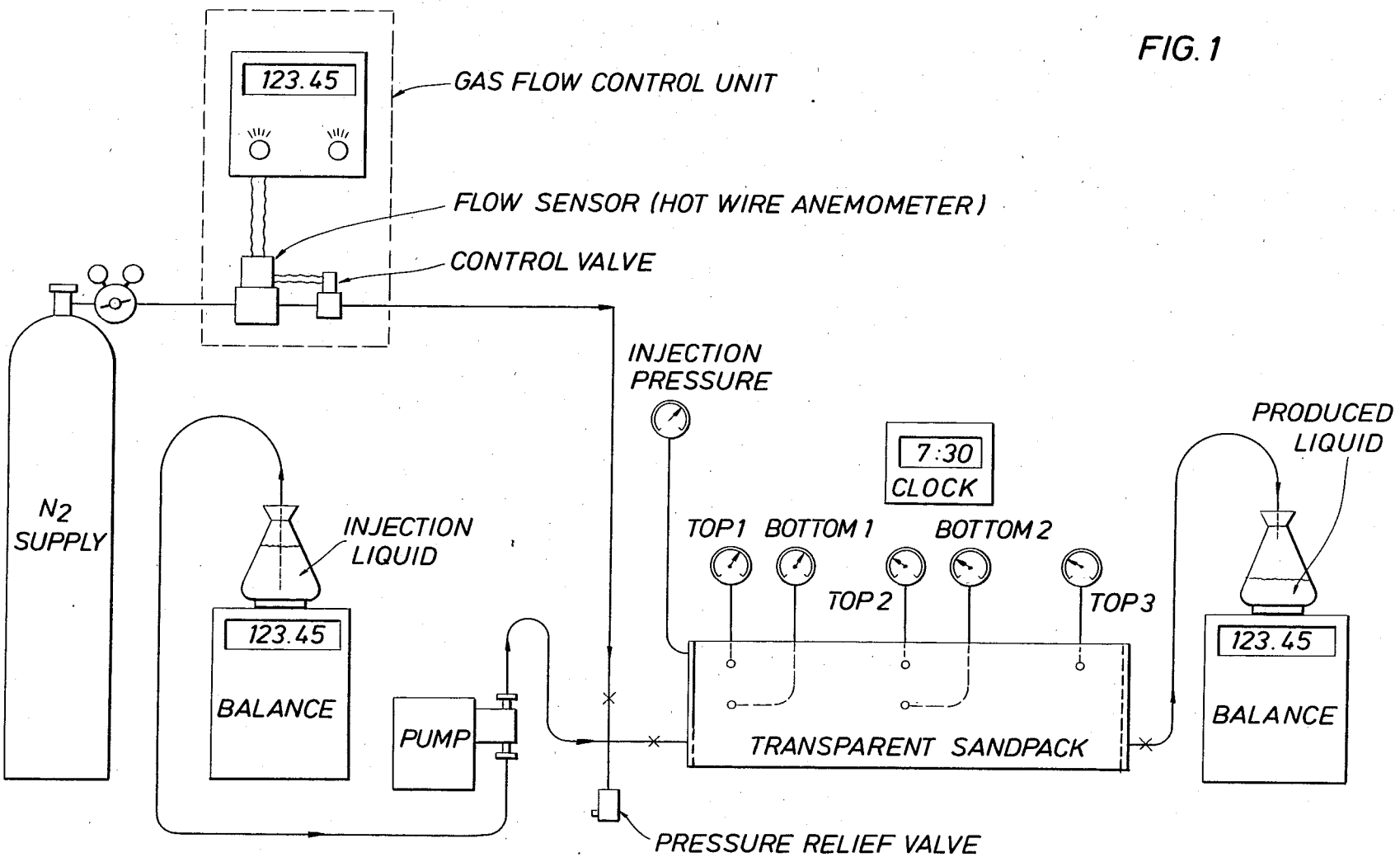
FIG. 1 is a schematic illustration of an apparatus for fluid flow experiments in transparent sand packs or synthetic reservoir formations.

FIG. 1 shows an apparatus for conducting fluid flow and/or oil displacement experiments within a synthetic reservoir formation consisting of a 20-inch by 3.94-inch by 0.78-inch transparent Lucite® box filled with Flint Shot unconsolidated silica sand. The porosity of the sand pack was 34% and its permeability was 110 darcys. Screens having pore sizes larger than those of the pack were fitted to the inflow and outflow faces of the pack. The screen at the inflow end was located at the bottom of the pack and arranged not to act as a foam generator. The screen at the outflow end covered the entire cross sectional area. This arrangement allowed the injection of foam components only near the bottom of the sand pack and the production of fluid from along the entire outflow face of the sand. Six pressure taps were mounted along the sand pack, as indicated on the drawing, for measuring: injection pressure, top 1 and bottom 1 pressures near the inlet end of the sand pack, top 2 and bottom 2 pressures near the middle of the sand pack and top 3 pressures near the outlet of the sand pack.

In typical experiments nitrogen and 0.5% by weight Stepanflo-30 alpha-olefin sulfonate surfactant with 1% by weight sodium chloride were used as foam components. The experiments were conducted with a nitrogen constant mass flow rate corresponding to 15 ccs per minute measured at standard conditions at a surfactant flow rate of 1.5 ccs per minute. This gave a fractional flow of 0.91 at standard conditions. In experiments using an oil the oil was an 85/15 mixture of Nujol/Shell-Sol 71 having a viscosity of 47 cp. and a density of 0.83 g/cm$^3$. Weights of liquid injected and produced were continuously monitored to allow computation of average gas saturation in the experiments without oil. In the experiments involving oil, the amount of the oleic and aqueous phases produced were measured volumetrically. At times the produced emulsions were broken by centrifuging. The connate water and surfactant solutions were colored with blue and red food colors respectively, and the oil was colored with a green organic dye to aid flow visualization.

Figure 2:
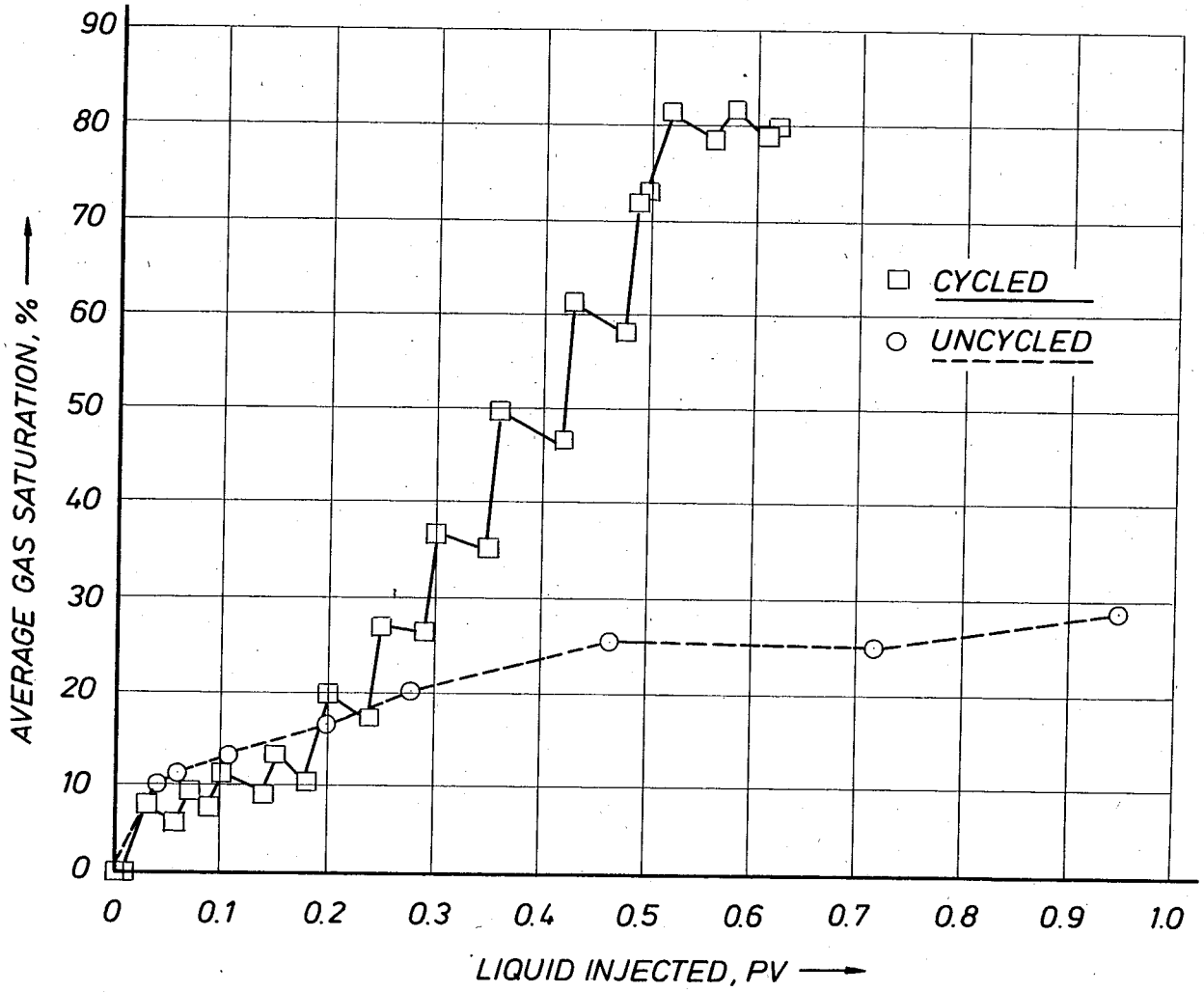
FIG. 2 is a graph of gas saturation versus amount of liquid injected during a fluid flow through such an apparatus.

FIG. 2 shows average gas saturation histories for pressurecycling flow and continuous flow of the foam components through the sand pack in the absence of oil. The sand pack was initially fully saturated with water in both experiments. In the pressure-cycle experiment, typical of the process of the present invention, the foam components were continuously injected with the producer shut-in throughout the pressure buildup cycle. When the pressure throughout the sand pack and within the simulated producing well reached 15 to 20 psig, the producer was opened, while maintaining the same rate of injection. This reduced the pressure at the outflow end of the sand pack to substantially atmospheric pressure and propagated a wave of pressure reduction, upstream of the fluid flow, through the sand pack. When no further decrease in the pressure was noted throughout the sand pack, the producer was shut in to repeat the pressure-buildup cycle. The time required to conduct one complete pressure-buildup and blowdown cycle was sensitive to the magnitude of the gas saturation within the sand pack. As the gas saturation increased it took longer and longer times for the pressure to build up to the predetermined level. For the pressure-cycle experiment shown in FIG. 2, the first pressure-blowdown cycle took only five minutes, with 0.021 PV liquid being injected. The fifth cycle took ten minutes, with 0.042 PV liquid injected, and the eleventh cycle took seventeen minutes, with 0.072 PV liquid being injected.

The pressure cycles made efficient use of the foam components. Where the sand pack contained 100% initial water saturation, a strong foam began to form with the addition of only 0.1 PV surfactant, at which time the saturation of gas was 11%. The gas saturation increased to a maximum of about 82% with the injection of 0.55 PV of surfactant (see FIG. 2). The passage of the strong foam through the sand pack could be detected by both visual observation and the increase in pressure at the monitoring locations along the pack.

For the same mass injection rates, the gas saturation increased much slower for the continuous-flow experiment. The gas saturation was only 28% after 1 PV of surfactant was injected at which time only a weak foam was formed. Strong foam was seen to propagate only after about 5 PV of surfactant was injected.

Figure 3:
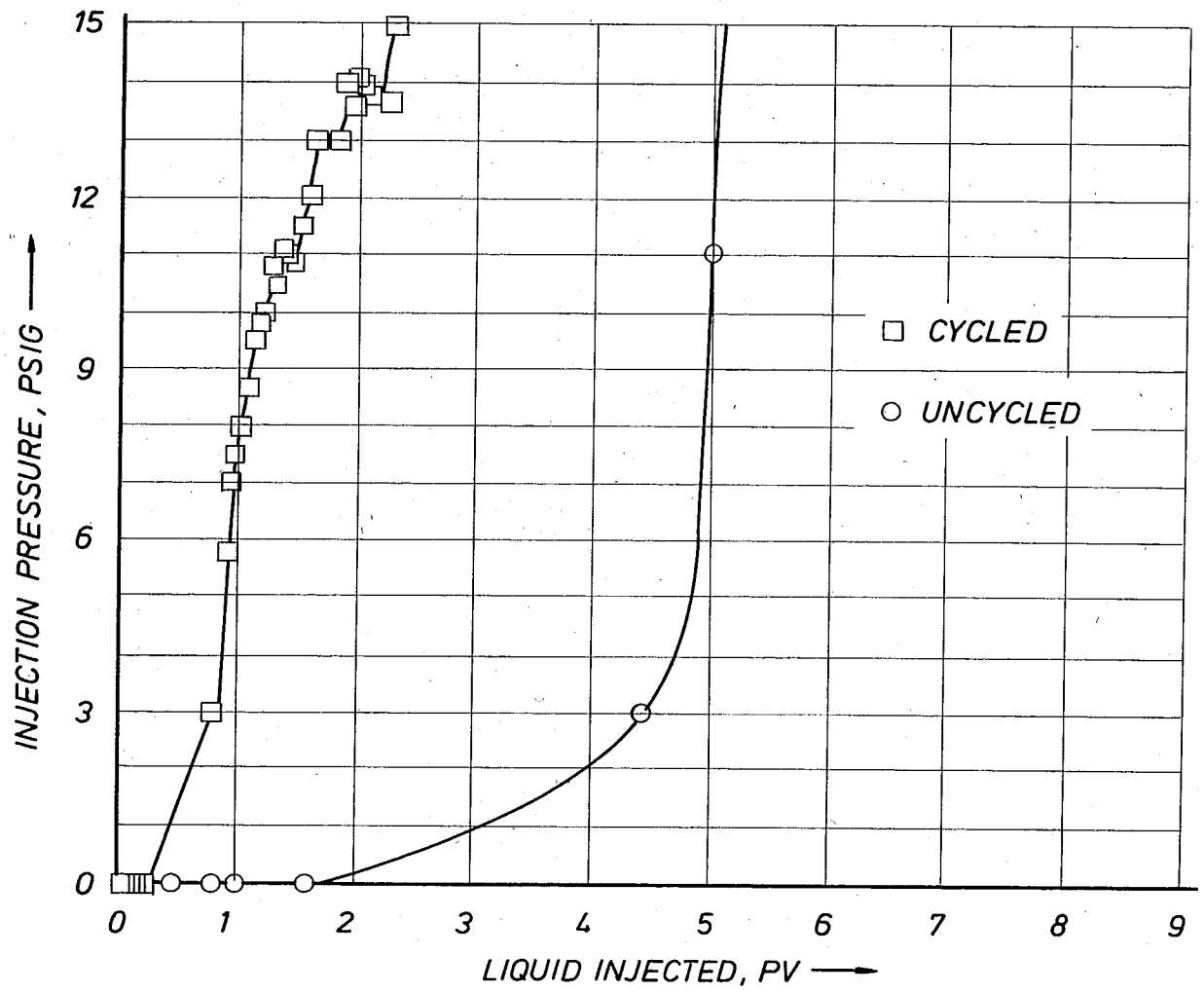
FIG. 3 is a graph of injection pressure versus amount of liquid injected in similar flow experiments.
Figure 4:
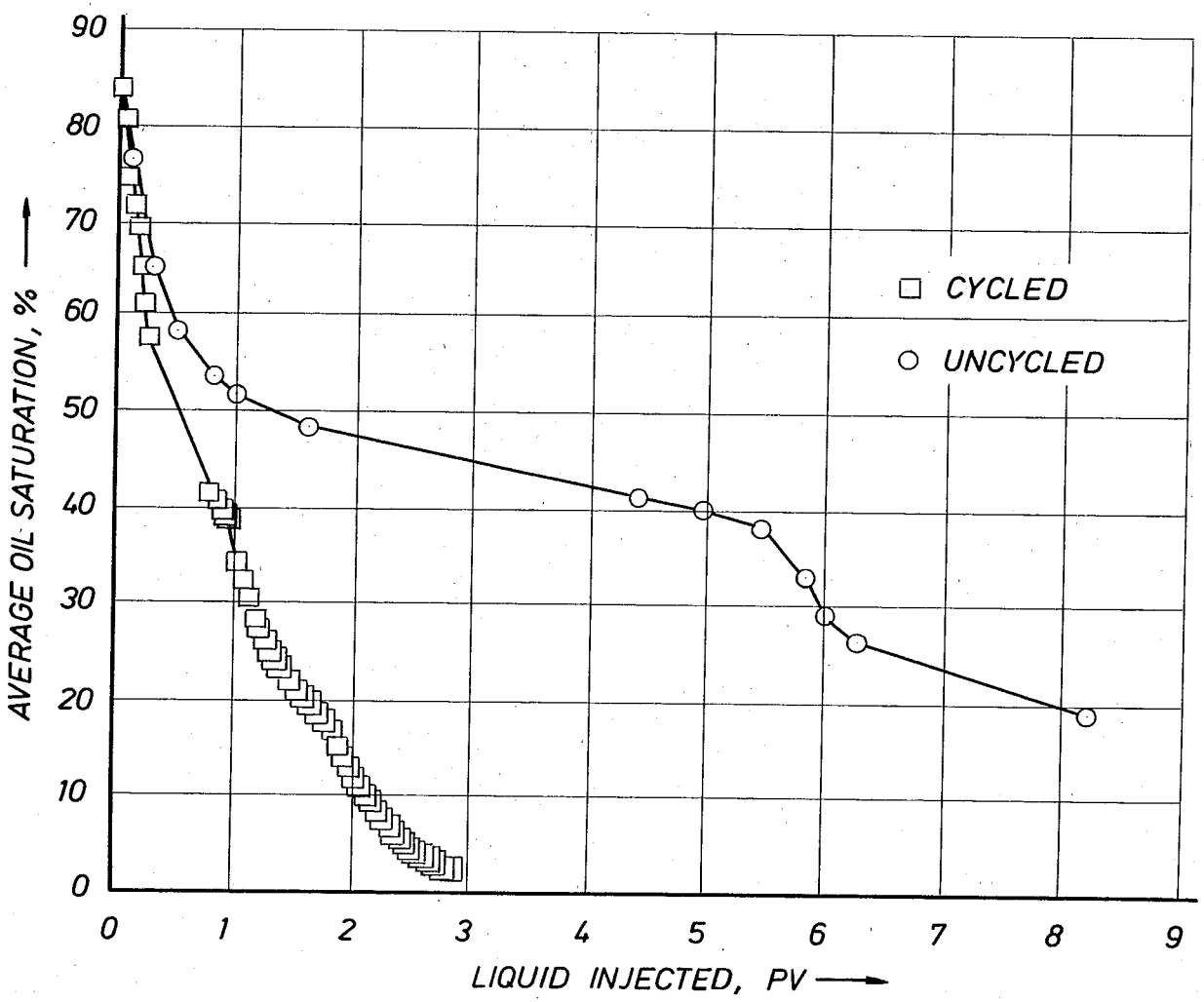
FIG. 4 is a graph of oil saturation versus amount of liquid injected in flow experiments in such an apparatus.

FIGS. 3 and 4 show the results of pressure-cycle and continuous-flow experiments in a sand pack initially saturated with high viscosity refined oil (47 cps.) so that the pack contained about 90% oil and 10% water. In such experiments, as in the case of the absence of oil, the pressure cycles began to generate a strong foam earlier than a continuous flow, earlier in terms of pore volume of surfactant and gas injected. This can be seen from the injection pressure graph of FIG. 3 (in which only the residual pressures are plotted in the cycled case). Only about 0.8 PV of surfactant injection was needed to generate a strong foam using pressure cycles whereas about 5 PV were required for the continuous flow. Again, the time to complete each pressure-buildup and blowdown cycle increased with increasing gas saturation. The completion of the initial cycles took about 6 minutes, with 0.025 PV liquid injected, while near the end of the experiment a complete cycle took about 12 minutes, with 0.050 PV liquid injected.

FIG. 4 shows that the cycled pressure flow also recovered more oil with less injected pore volumes of surfactant and gas than the continuous flow. The difference was substantial. At 1 PV of surfactant injected, the pressure cycling recovered 62% of the 90% saturation of original oil in place whereas the continuous flow recovered only 43%. At 2 PV of surfactant injected, the corresponding recoveries were 87% and 47%. The difference became 97% versus 50% at 3 PV of surfactant injected.

It was observed that a continuous-flow procedure gave poor oil recovery before a strong foam was formed when about 5 PV of surfactant injected. Prior to this time the injected surfactant and gas were segregated by gravity. Oil was displaced from a zone in which a gas channel was developing along the top of the pack while the surfactant tongue or layer was developing along the lower half of the pack.

COMPOSITIONS AND PROCEDURES SUITABLE FOR USE IN THE PRESENT INVENTION

In general, the reservoir treated can comprise substantially any light or heavy oil reservoir having a permeability suitable for an application of a fluid drive oil recovery process. The gas used as the gaseous phase of the fluids injected to form a foam within the reservoir can comprise substantially any gas or vapor which is (a) substantially unreactive and insoluble in the aqueous liquid and oil encountered in the reservoir and (b) is gaseous at the temperature encountered in the portion of the reservoir through which the oil is displaced. The water and surfactant used in the foam components can comprise substantially any aqueous solution and foaming surfactant capable of foaming the gas and liquid used, within the reservoir to be treated. In general, the individual kinds and amounts of the foam-forming components should be correlated with the temperature, oil, water and mineral properties of the reservoir to be treated so as to be capable of providing a relatively strong foam, at least as soon as the gaseous component is expanded to the extend capable of being provided within the reservoir by an outflowing fluid from a production well. In general, the gaseous fluids can comprise nitrogen, air, flue gas, $CO_2$, methane, steam, or the like.

In employing the present invention in recovering heavy oil from a reservoir in which the flow path of steam injected into the reservoir is not confined by layers of different absolute permeability, the foam-forming components preferably comprise a relatively wet steam having an aqueous phase which contains a relatively water-soluble surfactant and a monovalent-cation-containing electrolyte and a gas phase which contains a small but significant proportion of noncondensable gas. The kinds and proportions of such components are preferably arranged so that when they are displaced through a preferentially steam permeable channel within the reservoir they form a foam having a mobility which is significantly less than that of steam alone. Suitable components for forming such a steam foam and suitable procedures for conducting such a steam-channel-expanding steam drive are described in U.S. Pat. No. 4,086,964 and the disclosures of that patent are incorporated herein by reference.

In general, in the present process, the foam forming components can be injected simultaneously or sequentially, as long as they form a substantially homogeneous mixture before or soon after they enter the reservoir. Those components should be injected in response to an injection pressure sufficient to increase the pressure within the reservoir without fracturing the reservoir. When a significant increase of pressure in and around a production well is at least imminent, the production of fluid is initiated from that well. Preferably, such a production is initiated in response to an increase of about two times the normal bottomhole pressure near the production well to just below the formation fracturing pressure.

After such a pressure increase at a production well, fluid is produced from that well at a rate which is preferably as high as is feasible in good engineering practices for operating the well without damage to the well equipment or surrounding reservoir. Such a production of fluid is preferably continued for so long as the ratio of oil to water in the produced fluid is relatively high and/or the bottomhole pressure of the fluid in the production well declines to near the initial bottomhole pressure. During such a production from one or more producing wells the rate of fluid injection into the adjacent injection well (or wells) is kept at least substantially as high as the initial rate of injection. As will be apparent to those skilled in the art, relatively short duration fluctuations are tolerable, as long as the average pressure is substantially as specified.

After a significant decline in oil cut or production well bottomhole pressure, the outflow of fluid from the production well is again restricted so that the pressure within the reservoir is again increased by the continued injection of fluid through at least one injection well. The sequence of injecting foam forming fluid while restricting fluid outflow and then producing while continuing that injection is repeated as often as is economical or desirable in producing oil from the reservoir.

What is claimed is:

1. In a process for recovering oil from an oil-containing subterranean reservoir, in which process the reservoir has a base matrix which is substantially free of fractures or streaks having a permeability drastically different from the base matrix, said reservoir is encountered by at least one each of injection and production wells, and oil is displaced toward a production well by injecting a mixture of aqueous liquid, gaseous fluid and surfactant, an improvement comprising:

injecting through at least one injection well a foam forming fluid consisting essentially of said mixture in which said gas, aqueous liquid and surfactant are substantially homogeneously mixed before entering the reservoir and are capable of forming a relatively strong foam within the pores of the reservoir;

during said injection, allowing little or no fluid outflow through any adjacent production well, so that the fluid pressure within the reservoir and within at least one adjacent production well becomes at least substantially doubled relative to the normal reservoir pressure near the production well;

outflowing fluid from at least one production well in which the pressure increase has occurred, at an outlfow rate sufficient to reduce the reservoir pressure;

during said outflow continuing the injection of said foam forming fluid through at least one injection well at a rate at least substantially equalling the initial rate;

when the reservoir pressure on the fluid being outflowed from said production well has significantly declined, allowing little or no fluid outflow through that well while continuing to inject said foam forming fluid through at least one injection well at a rate at least substantially equalling the initial fluid injection rate, so that the pressure is again increased within the reservoir and at least one production well adjacent to the injection well; and repeating said sequence of injecting the foam forming fluid while restricting fluid outflow and producing fluid while continuing fluid injection, and recovering oil from the fluid being produced.

2. The process of claim 1 in which a plurality of injection and production wells are arranged in a pattern of adjacent wells which are responsive to each other comprise said injection and production wells.

3. The process of claim 1 in which the injected gas is nitrogen.

4. The process of claim 1 in which the injected gas is steam.

5. The process of claim 1 in which the injected fluid comprises a mixture of steam, noncondensable gas, dissolved salt and surfactant.

6. The process of claim 5 in which the surfactant is an olefin sulfonate surfactant.

7. The process of claim 5 in which the reservoir is a relatively thick heavy oil reservoir which is susceptible to gravity override.

8. The process of claim 7 in which a steam zone extends substantially completely between the injection and production wells.

9. The process of claim 8 in which the surfactant is an olefin sulfonate surfactant.

* * * * *